US011944865B2

(12) United States Patent
Chen

(10) Patent No.: US 11,944,865 B2
(45) Date of Patent: Apr. 2, 2024

(54) CONSTANT TENSION MECHANISM OF TRAINING MACHINE

(71) Applicant: WELLGO PEDAL'S CORP., Taichung (TW)

(72) Inventor: Chung-I Chen, Taichung (TW)

(73) Assignee: WELLGO PEDAL'S CORP., Taichung (TW)

( * ) Notice: Subject to any disclaimer, the term of this patent is extended or adjusted under 35 U.S.C. 154(b) by 395 days.

(21) Appl. No.: 17/380,394

(22) Filed: Jul. 20, 2021

(65) Prior Publication Data

US 2022/0023712 A1 Jan. 27, 2022

(30) Foreign Application Priority Data

Jul. 23, 2020 (TW) ..... 109209443

(51) Int. Cl.
*A63B 22/06* (2006.01)
*A63B 21/00* (2006.01)

(52) U.S. Cl.
CPC ..... *A63B 22/0605* (2013.01); *A63B 21/15* (2013.01)

(58) Field of Classification Search
CPC ..... A63B 22/0605–2022/0658; A63B 21/15; A63B 21/154–156
See application file for complete search history.

(56) References Cited

FOREIGN PATENT DOCUMENTS

CN 108939415 A * 12/2018 ..... A63B 22/0605
KR 20090090743 A * 8/2009 ..... A63B 22/0605

* cited by examiner

*Primary Examiner* — Jennifer Robertson
(74) *Attorney, Agent, or Firm* — Muncy, Geissler, Olds & Lowe, P.C.

(57) ABSTRACT

A constant tension mechanism of a training machine is provided, including: a base, configured to be connected to a body of the training machine; an elastic member, abutted against the base; and a tension mechanism, including a movable member movably connected with the base and abutted against the elastic member, and at least one tension pulley rotatably disposed on the movable member and configured to urge a belt connected to the body; wherein relative to the base a direction in which the elastic member forces the movable member and a direction in which the at least one tension pulley moves point toward the same direction.

9 Claims, 5 Drawing Sheets

CONSTANT TENSION MECHANISM OF TRAINING MACHINE

BACKGROUND OF THE INVENTION

Field of the Invention

The present invention relates to a constant tension mechanism of a training machine.

Description of the Prior Art

Generally, an exercise bike is usually driven by a belt transmission mechanism. The exercise bike includes a drive wheel that can be driven by a pedal, a resistance wheel, and a belt that connects the drive wheel and the resistance wheel. The belt is under tension to make the drive wheel effectively drive the resistance wheel to rotate. However, the belt is prone to degrading and loosing due to long-term tension, and insufficient tension causes the driving wheel or the resistance wheel to slip easily during rotation, which is unable to effectively transmit the driving force, and results in poor durability.

The present invention is, therefore, arisen to obviate or at least mitigate the above-mentioned disadvantages.

SUMMARY OF THE INVENTION

The main object of the present invention is to provide a constant tension mechanism of a training machine.

To achieve the above and other objects, a constant tension mechanism of a training machine is provided, including: a base, configured to be connected to a body of the training machine; an elastic member, abutted against the base; and a tension mechanism, including a movable member movably connected with the base and abutted against the elastic member, and at least one tension pulley rotatably disposed on the movable member and configured to urge a belt connected to the body; wherein relative to the base a direction in which the elastic member forces the movable member and a direction in which the at least one tension pulley moves point toward the same direction.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
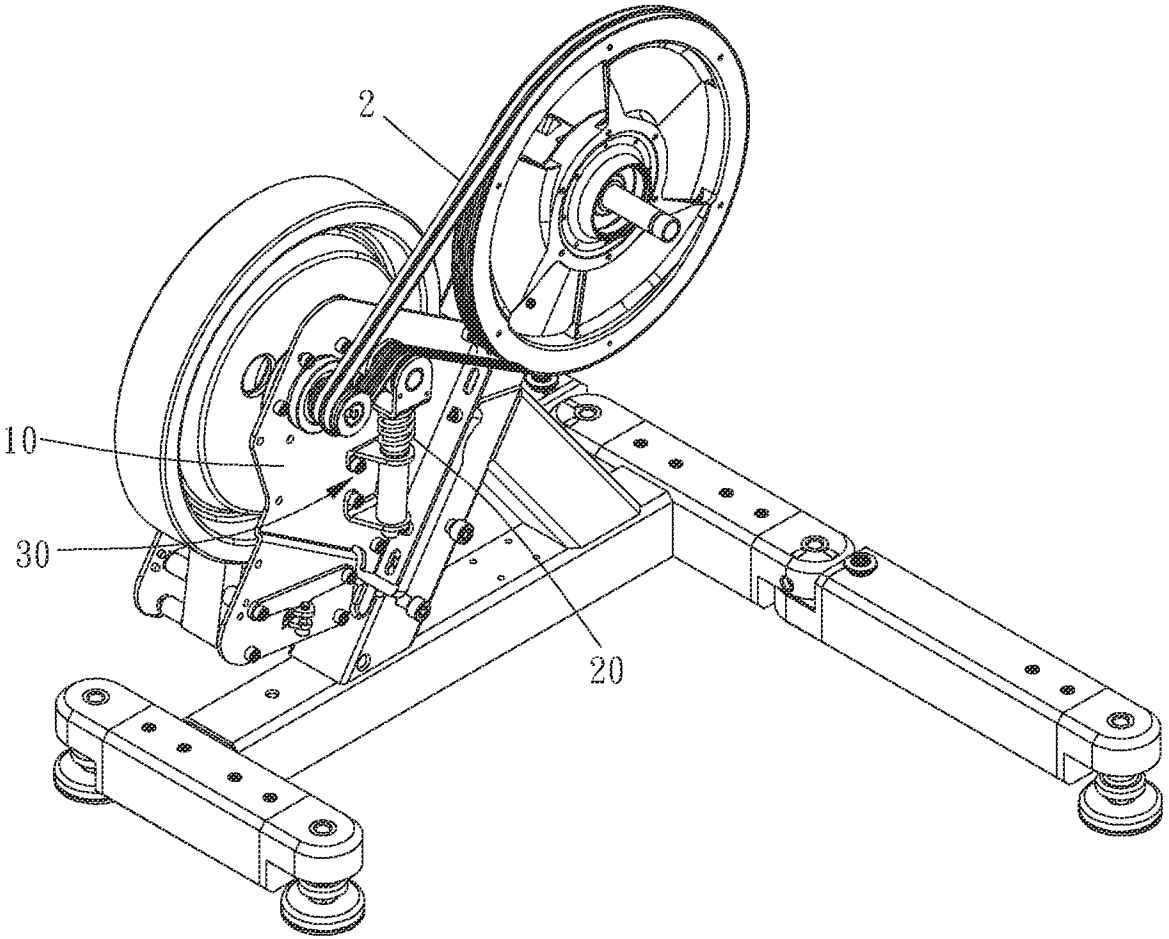
FIG. 1 is a stereogram of a preferable embodiment of the present invention.
Figure 2:
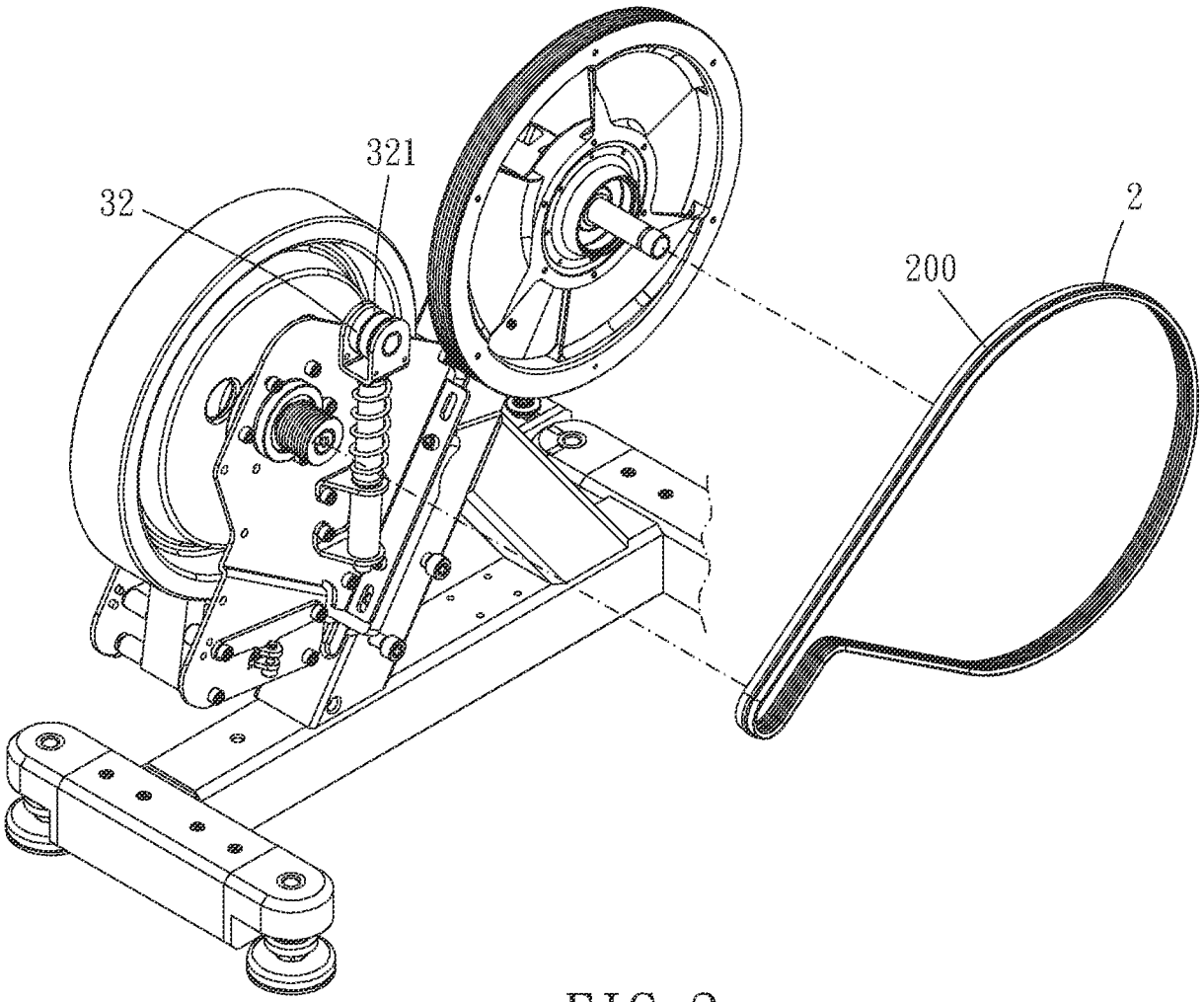
FIG. 2 is a partial breakdown drawing of a preferable embodiment of the present invention.

Please refer to FIGS. 1 to 6 for a preferable embodiment of the present invention. A constant tension mechanism 1 of a training machine of the present invention includes a base 10, an elastic member 20 and a tension mechanism 30.

The base 10 is configured to be connected to a body of the training machine; the elastic member 20 is abutted against the base 10; the tension mechanism 30 includes a movable member 31 movably connected with the base 10 and abutted against the elastic member 20, and at least one tension pulley 32 rotatably disposed on the movable member 31 and configured to urge a belt 2 connected to the body. Relative to the base 10, a direction in which the elastic member 20 forces the movable member 31 and a direction in which the at least one tension pulley 32 moves point toward the same direction. Whereby, the elastic member 20 can urge the tension pulley 32 to normally abut against the belt 2 so as to tense the belt 2.

Figure 4:
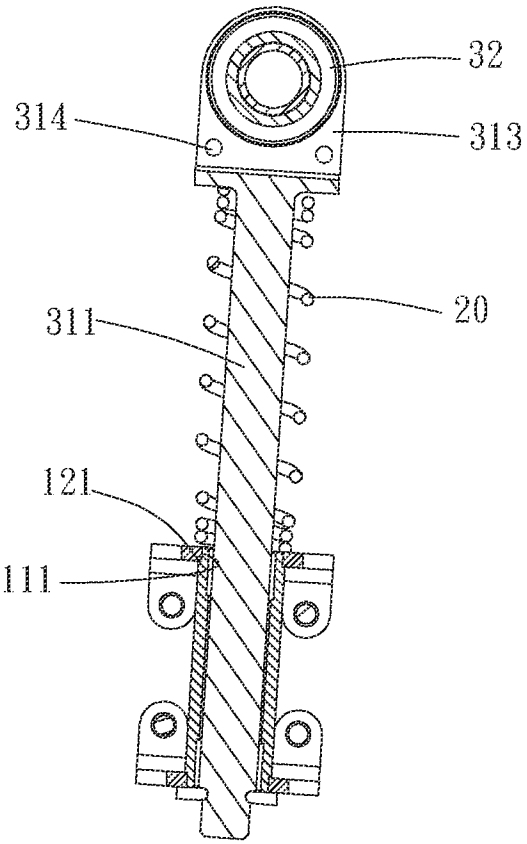
FIG. 4 is a cross-sectional view of the constant tension mechanism according to a preferable embodiment of the present invention.

The movable member 31 includes a rod member 311 movably inserted to the base 10 and a bracket 312 connected with the rod member 311, the at least one tension pulley 32 is rotatably connected to the bracket 312, and the elastic member 20 is abutted against the bracket 312. The bracket 312 includes two side plates 313 facing each other, the at least one tension pulley 32 is rotatably disposed between the two side plates 313, and the two side plates 313 are protrusive beyond a circumferential surface of the at least one tension pulley 32 (as shown in FIG. 4), which restricts the belt 2 between the two side plates 313 and prevents disengagement of the belt 2. Preferably, the tension mechanism 30 includes two said tension pulleys 32 which are coaxial and axially spaced. A groove 321 is provided between the two said tension pulleys 32 and configured for engagement of a rib 200 of the belt 2, which prevents the belt 2 from slipping laterally. At least one of the two side plates 313 includes at least one through hole 314 configured for connection of other components.

Figure 3:
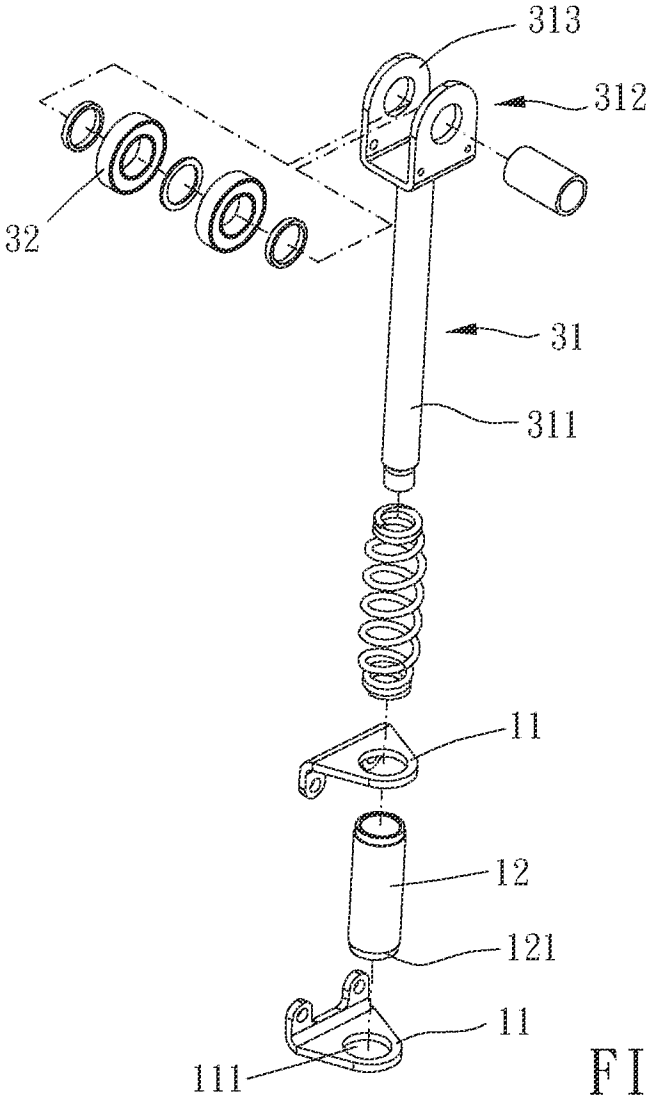
FIG. 3 is a breakdown drawing showing a constant tension mechanism according to a preferable embodiment of the present invention.
Figure 5:
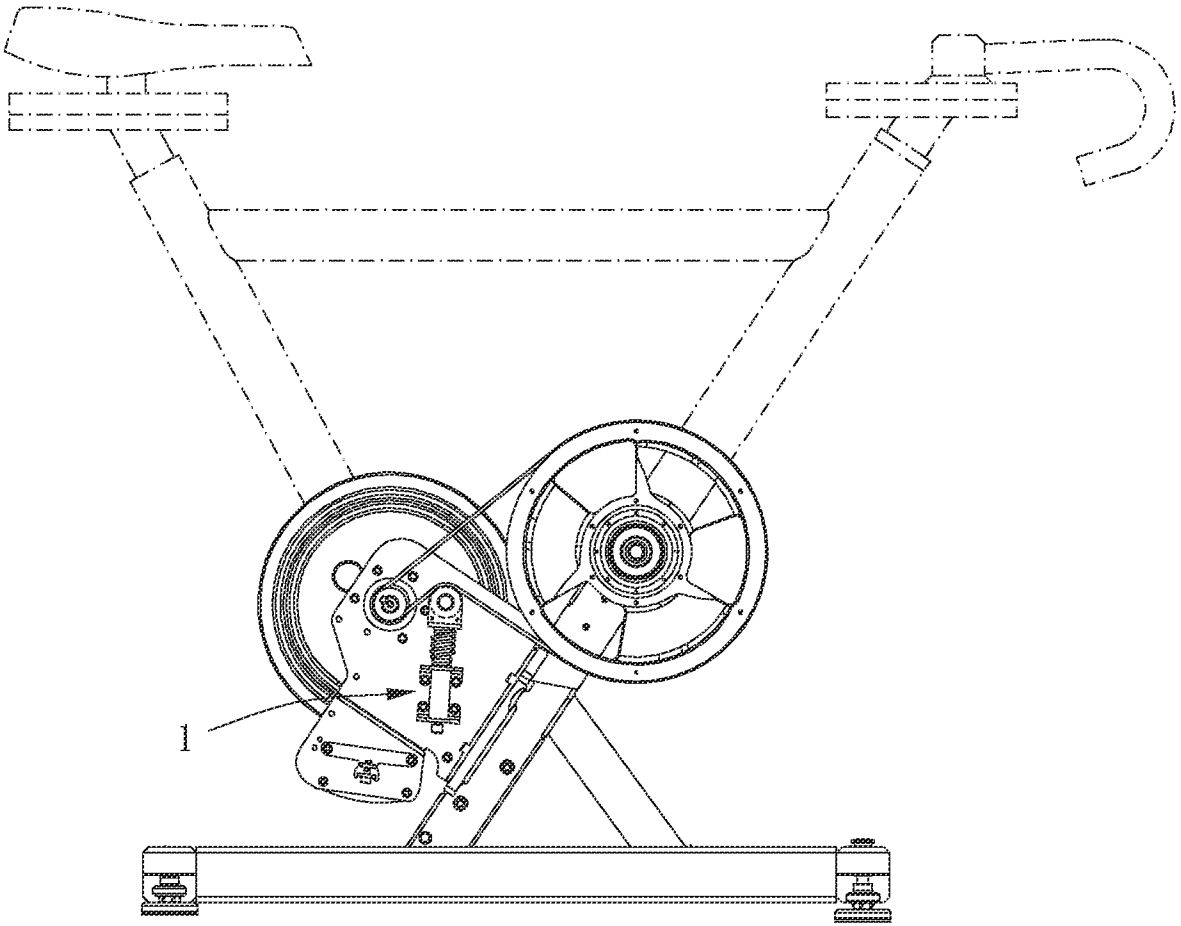
FIG. 5 is drawing showing operation of the constant tension mechanism according to a preferable embodiment of the present invention.
Figure 6:
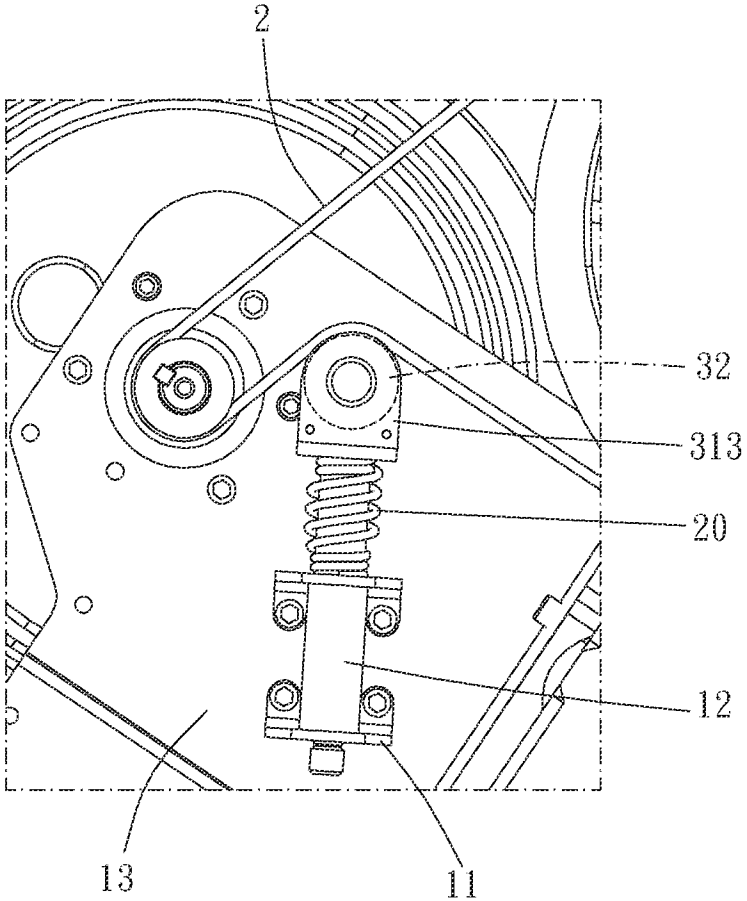
FIG. 6 is a partial enlargement of FIG. 5.

Please refer to FIGS. 3 and 4, the base 10 includes two side walls 11 and a tubular member 12 disposed between the two side walls 11. The rod member 311 is movably inserted within the tubular member 12, and the elastic member 20 is disposed around the rod member 311, which ensures that the tension pulley 32 moves in a direction the same as a direction in which the force of the elastic member 20 is applied. The tubular member 12 and the rod member 311 coaxially and straightly extend, and an axial direction of the rod member 311 is perpendicular to an axial direction of the at least one tension pulley 32. Preferably, an extension of the axial direction of the rod member 311 intersects with an axial direction of the at least one tension pulley 32 so that the force from the elastic member 20 can be directly transmitted to the tension pulley 32 to sufficiently urge and tense the belt 2. However, the tubular member and the rod member may extend non-straightly.

Specifically, the elastic member 20 is a coil spring, and a distal coil of the coil spring has a relatively smaller diameter than diameters of other coils of the coil spring and is abutted against at least one of the tubular member 12 and one said side wall 11. Another distal coil of the coil spring has a relatively smaller diameter than diameters of other coils of the coil spring and is abutted against the bracket 312. The coil spring can bias the bracket 312 in a direction away from the tubular member 12, and it has a simple structure and is easy to assemble. The base 10 further includes a base portion 13 configured to be connected to the body, and each said side wall 11 is, preferably, detachably connected to the base portion 13 and includes an assembling hole 111. Each of two ends of the tubular member 12 includes an annular shoulder 121 which is abutted against a hole wall of one said assembling hole 111, which is easy to assemble and is stable, and is highly compatible in use. In another embodiment, the two side walls may be fixedly connected to the base portion; the base may further include an abutting portion at a side of the bracket opposite to the tubular member, the rod member may include a projection extending radially, and the elastic member is disposed between the projection and the abutting portion.

Give the above, the constant tension mechanism of the training machine is configured to be connected to the body of the training machine, and the tension pulley is configured to tense the belt of the training machine, and the elastic member urges the movable member so that the tension pulley stably tenses the belt, which effectively reduces influence of insufficient tension to the belt so that it has good force transmission efficiency and is durable.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A constant tension mechanism of a training machine, including:

a base, configured to be connected to a body of the training machine;

an elastic member, abutted against the base; and a tension mechanism, including a movable member movably connected with the base and abutted against the elastic member, and at least one tension pulley rotatably disposed on the movable member and configured to urge a belt connected to the body;

wherein relative to the base a direction in which the elastic member forces the movable member and a direction in which the at least one tension pulley moves point toward the same direction;

wherein the movable member includes a rod member movably inserted to the base and a bracket connected with the rod member, the at least one tension pulley is rotatably connected to the bracket, and the elastic member is abutted against the bracket;

wherein the base includes two side walls and a tubular member disposed between the two side walls, the rod member is movably inserted within the tubular member, and the elastic member is disposed around the rod member.

2. The constant tension mechanism of the training machine of claim 1, wherein the tension mechanism includes two said tension pulleys which are coaxial and axially spaced.

3. The constant tension mechanism of the training machine of claim 1, wherein the bracket includes two side plates facing each other, the at least one tension pulley is rotatably disposed between the two side plates, and the two side plates are protrusive beyond a circumferential surface of the at least one tension pulley.

4. The constant tension mechanism of the training machine of claim 1, wherein the elastic member is a coil spring, and a distal coil of the coil spring has a relatively smaller diameter than diameters of other coils of the coil spring and is abutted against at least one of the tubular member and one said side wall.

5. The constant tension mechanism of the training machine of claim 4, wherein the tension mechanism includes two said tension pulleys which are coaxial and axially spaced, a groove is provided between the two said tension pulleys and configured for engagement of a rib of the belt; the bracket includes two side plates facing each other, the at least one tension pulley is rotatably disposed between the two side plates, and the two side plates is protrusive beyond a circumferential surface of the at least one tension pulley; at least one of the two side plates includes at least one through hole; a distal coil of the coil spring has a relatively smaller diameter than diameters of other coils of the coil spring and is abutted against the bracket; the base further includes a base portion configured to be connected to the body, each said side wall is detachably connected to the base portion and includes an assembling hole, each of two ends of the tubular member includes an annular shoulder which is abutted against a hole wall of one said assembling hole; the tubular member and the rod member coaxially and straightly extend; an axial direction of the rod member is perpendicular to an axial direction of the at least one tension pulley; and an extension of the axial direction of the rod member intersects with an axial direction of the at least one tension pulley.

6. The constant tension mechanism of the training machine of claim 1, wherein the elastic member is a coil spring, and a distal coil of the coil spring has a relatively smaller diameter than diameters of other coils of the coil spring and is abutted against the bracket.

7. The constant tension mechanism of the training machine of claim 1, wherein the tubular member and the rod member coaxially and straightly extend.

8. The constant tension mechanism of the training machine of claim 7, wherein an axial direction of the rod member is perpendicular to an axial direction of the at least one tension pulley.

9. The constant tension mechanism of the training machine of claim 8, wherein the axial direction of the rod member and the axial direction of the at least one tension pulley intersect.

* * * * *